US006701704B2

(12) United States Patent
Foster et al.

(10) Patent No.: US 6,701,704 B2
(45) Date of Patent: Mar. 9, 2004

(54) PROCESSING TEXTILE MATERIALS

(75) Inventors: Peter William Foster, Alderley Edge (GB); Duncan Cameron Ferrier, Tiverton (GB); Ujithe Sujeewa Wickramasinghe Gunasekera, Manchester (GB)

(73) Assignee: University of Manchester Institute of Science and Technology, Manchester (GB)

( * ) Notice: Subject to any disclaimer, the term of this patent is extended or adjusted under 35 U.S.C. 154(b) by 0 days.

(21) Appl. No.: 10/041,051

(22) Filed: Jan. 7, 2002

(65) Prior Publication Data

US 2002/0104305 A1 Aug. 8, 2002

Related U.S. Application Data

(63) Continuation of application No. PCT/GB00/02610, filed on Jul. 7, 2000.

(30) Foreign Application Priority Data

Jul. 8, 1999 (GB) ..... 9915922
Jul. 8, 1999 (GB) ..... 9915923
Jul. 8, 1999 (GB) ..... 9915924

(51) Int. Cl.[7] ..... D01H 4/02
(52) U.S. Cl. ..... 57/333; 57/289; 57/403
(58) Field of Search ..... 28/271, 272, 273; 139/435.1, 435.2, 435.3, 435.4, 435.5, 435.6; 57/1 R, 289, 310, 333, 350, 403; 226/7, 97.1, 97.2, 97.3, 97.4

(56) References Cited

U.S. PATENT DOCUMENTS 3,449,809 A 6/1969 Shin ..... 28/72.2
3,577,721 A * 5/1971 Schmick et al. ..... 28/272
3,783,596 A * 1/1974 Waldkirch ..... 28/272
4,064,684 A * 12/1977 Nijhuis ..... 57/296
4,074,727 A * 2/1978 Kwok et al. ..... 139/435.4
4,138,840 A * 2/1979 Greenway et al. ..... 57/289
4,398,386 A * 8/1983 Endo et al. ..... 57/288
4,408,445 A * 10/1983 Wilkie ..... 57/246
4,624,102 A * 11/1986 Bell, Jr. ..... 423/447.1
4,905,468 A * 3/1990 Tanae et al. ..... 57/291
5,287,606 A * 2/1994 Ruef ..... 28/219
5,390,400 A * 2/1995 Jacob et al. ..... 28/274
5,802,832 A 9/1998 Foster ..... 57/264
6,397,444 B1 * 6/2002 Foster et al. ..... 28/220
6,438,934 B1 * 8/2002 Foster et al. ..... 57/264

FOREIGN PATENT DOCUMENTS

| | | |
|---|---|---|
| EP | 0 703 306 A1 | 3/1996 |
| GB | 1 592 646 | 7/1981 |
| JP | 52 08 5 545 A | 7/1977 |
| JP | 61 102 421 | 5/1986 |
| JP | 61 102 422 | 5/1986 |
| JP | 61 102 423 | 5/1986 |
| WO | WO 95/32325 | 11/1995 |

OTHER PUBLICATIONS

International Search Report for PCT/GB00/02610, mailed Dec. 6, 2000.

* cited by examiner

*Primary Examiner*—John J. Calvert
*Assistant Examiner*—Shaun R Hurley
(74) *Attorney, Agent, or Firm*—Wallenstein Wagner & Rockey, Ltd.

(57) ABSTRACT

A method of processing textile material is disclosed in which the material (13) is passed along a predetermined path through a liquid jet device (50, 70, 80, 90, 100, 120, 130) applying a force to the material (13) transversely to the axis of the material (13). High pressure water is used to form one or more belts (11, 12) for applying twist to a yarn (13), sliver or roving (273), or as a jet to intermingle one or more yarns (13). The water may serve to cool the yarn (13) after beating in a false twist process.

28 Claims, 10 Drawing Sheets

PROCESSING TEXTILE MATERIALS

This Application is a continuation of International Application No. PCT/GB00/02610, with an international filing date of Jul. 7, 2000, now pending, and herein incorporated by reference.

TECHNICAL FIELD

This invention relates to the processing of textile materials, in particular the jet texturing of filament and/or staple products. Such processing includes the false twisting of textile filament yarns, intermingling of multifilament yarns, the co-mingling of two or more filament yarns, the combining of filament and staple yarns and the twisting of staple products, i.e. yarn, sliver or roving.

BACKGROUND OF THE INVENTION

It has been proposed to apply a false twist to a textile filament yarn by passing the yarn through a texturing jet in which a jet or jets of air are directed onto the travelling yarn offset from its axis to impart a twisting torque to the yarn. The twist levels achievable by this method are very low by comparison with those achieved by the use of friction discs, belts and the like, hence the limited use commercially. The diameter of a textile yarn is relatively small, for example 0.2 mm for 150 Denier, and in consequence the tolerances on jet manufacture are extremely tight if satisfactory processing is to be achieved and consistency of performance from jet to jet. From a production costs point of view it is desirable to increase the yarn processing speed as much as possible. However, a limit on such speed is the surge speed, the speed at which satisfactory processing breaks down due to the long uncontrolled lengths of yarn in the large machines required for economic production.

It is also known to process one or more multifilament textile yarns by passing the yarn or yarns through a jet device in which a jet or jets of air are directed transversely of the travelling yarn or yarns to agitate the filaments or the fibres of the yarns. Such agitation may cause uniform texturing or intermittent texturing, i.e. intermingling or co-mingling. When intermittent, nips are produced in the yarn or yarns at spaced intervals. Since such jets rely on air turbulence, the degree of texturing or of nip spacing along the yarn is in consequence random. Whilst the average degree of texturing or nip production per unit length of yarn processed by such known jets may be satisfactory for certain textile applications, there are often long lengths of yarn produced having no texture or nips. These lengths of yarn, when used in knitted or woven fabrics, manifest themselves as unsatisfactory regions in the fabric.

Furthermore, it is also known to apply a twist to a textile staple product to give the product satisfactory coherence by passing the product through a twisting jet in which a jet or jets of air are directed onto the travelling product offset from its axis to impart a twisting torque to the product. The diameter of a textile product is relatively small, for example 0.6 mm for a 24 s $Ne_c$ (English cotton count) yarn, and in consequence the tolerances on jet manufacture are extremely tight if satisfactory processing is to be achieved and consistency of performance from jet to jet.

Typically a textile machine for performing any of the above processes can have over 200 processing stations, i.e. over 200 yarns are processed simultaneously in parallel threadlines. This means that the machines are very large, which leads to problems of ergonomics. Furthermore, the provision of tight tolerance jets and high pressure air to such jets is expensive and such machines are very noisy, particularly when one or more doors of jet boxes are open for threading purposes.

SUMMARY OF THE INVENTION

It is an object of the present invention to provide a method of processing textile materials, which overcomes, at least to a substantial extent, the above-mentioned disadvantages of known processing methods. It is also an object of the invention to enable the size of a machine for performing any one of the above mentioned processes to be reduced by a significant amount. It is a further object of the present invention to provide a method of texturing a textile filament yarn that increases twist levels that can be achieved, increases the surge speed during false twisting or produces more regular texturing along the length of the yarn. It is a further object of the present invention to provide a method of applying a twist to a textile staple product during the staple drawing process which increases twist levels that can be achieved or allows an increase of processing speed for the same twist level.

The invention provides a method of processing textile material comprising passing the material along a predetermined path through a liquid jet device applying a force to the material transversely to the axis thereof. The force may be a rotational force.

The invention also provides a method for producing textured textile materials, in which the material is textured by the above method and is cooled. The material may be cooled by the liquid jet device. The material may be heated prior to being cooled and textured, and may then be wound up. The material may be drawn prior to being cooled and textured. The method may also comprise applying a forwarding force or a retarding force to the material. The method may comprise applying at least one jet of liquid to the surface of the material transversely to the axis thereof. The method may comprise applying the at least one jet of liquid with components of velocity both axially of and transversely to the material path through the jet device. The method may comprise applying a plurality of jets of liquid disposed about the axis of the material path through the jet device. Preferably the liquid is water and may be cold water. The supply of water may be pulsed. The method may also comprise passing the material successively through a plurality of liquid jet devices. Consecutive jet devices may apply rotational forces to the material in the same or in opposite directions.

The material may be cooled in a cooling zone by immersion in a cooling liquid, in which case the cooling liquid may be moved in contraflow to the material passing through the cooling zone. The cooling zone and the liquid jet device may be contiguous. The cooling liquid may be the liquid of the jet device. The process may comprise heating the material by vapour, which may be superheated steam.

The invention also provides a method for applying a false twist to a filament yarn, in which the false twist is applied to the yarn by the above method and the yarn is cooled. The yarn may be heated prior to being cooled and twisted, and may then be wound up. The yarn may be passed through a twist trap, a heating zone, a cooling zone and the liquid jet device, being twisted by the latter so that the twist runs back to the twist trap, and then wound up. The yarn may be heated as far upstream as the twist trap. The yarn may be heated prior to passing through the twist trap and not further heated between the twist trap and the liquid jet device. The yarn may be drawn prior to being cooled and twisted. The yarn may be post treated prior to it being wound up. In this case the yarn may be passed with controlled overfeed through further heating apparatus. The further heating apparatus may comprise vapour heating, which may be superheated steam.

The method may comprise controlling the material by a feedback arrangement. In this case a property of the material may be measured and the measurement used to control the material processing. The measurement may be used to control the liquid jet device, a speed of the material or a heating step.

The material may be a continuous filament yarn and the method may comprise drawing the yarn to form a partially oriented yarn. Alternatively the material may be a plurality of yarns that are combined to form a single coherent yarn. One of the yarns may be a staple yarn.

The invention may also comprise apparatus for processing a textile material comprising a liquid jet device adapted to apply a force to a textile material transversely to the axis of the material as the material travels along a predetermined path through the jet device. The force may be a rotational force.

The apparatus may comprise cooling apparatus. The cooling apparatus may be a fluid cooling apparatus in which the material passes through a fluid to be cooled by heat transfer thereto.

The cooling apparatus may comprise a cooling chamber with a fluid inlet and a fluid outlet for cooling fluid to be passed therethrough, and a material inlet and material outlet. The cooling fluid may be passed contraflow relative to the material. The cooling chamber may comprise seals against escape of cooling fluid at the material inlet and the material outlet. The seals may be labyrinth seals and may be pressurised. The seals may be gas pressurised, and may be pressurised by compressed air. The cooling fluid may be a liquid and may be water. The flow of liquid through the cooling chamber may be arranged to be turbulent. The liquid jet device and the cooling apparatus may have a common liquid. Alternatively, the cooling apparatus may comprise the liquid jet device.

The apparatus may also comprise heating apparatus, which may be disposed upstream of the cooling apparatus. The apparatus may comprise winding apparatus disposed downstream of the liquid jet device. The apparatus may also comprise drawing means, which may be disposed upstream of the cooling apparatus. The heating apparatus, cooling apparatus and liquid jet device may be mounted in a common housing.

The liquid jet device may be adapted to apply a force to the travelling material along the axis of the material, i.e. a forwarding force or a retarding force. The jet device may apply at least one jet of liquid to the surface of the material transversely to the axis thereof, and the at least one jet of liquid may be offset from the axis of the material. The at least one jet of liquid may be directed to have velocity components both along and laterally of the material path through the jet device. A plurality of jets may be disposed about the material path through the jet device, preferably symmetrically. Three such jets may be provided. The liquid jet device may comprise a housing having an axial bore terminating in a material constricting outlet, the axis of the bore defining a material path therethrough, with at least one liquid flow channel aimed towards the outlet and offset from the axis. The liquid jet device may comprise a seal in the housing against liquid escape along the material path. The seal may be a labyrinth seal and may be pressurised. The seal may be gas pressurised, and may be pressurised by compressed air. Preferably the liquid jet device comprises a water jet device. A plurality of liquid jet devices may be disposed successively along the material path, and the plurality of jet devices may be provided in a common housing. Three such jet devices may be so provided. Consecutive liquid jet devices may be adapted to apply rotational forces to the product in the same or in opposite directions.

The heating apparatus may comprise a vapour heating apparatus. The vapour may be superheated steam. The heating apparatus may comprise a housing having seals against escape of steam at a material inlet and at a material outlet thereof. The seals may be labyrinth seals and may be pressurised. The seals may be gas pressurised, and may be pressurised by compressed air or by superheated steam. The heating apparatus, the cooling apparatus and the liquid jet device may be disposed in a common housing.

The apparatus may also comprise treatment means operable to post treat the yarn. In this case, the apparatus may comprise feed means operable to pass the yarn with controlled overfeed through a further heating apparatus. The further heating apparatus may be a vapour heating apparatus. The heating apparatus and the further heating apparatus may use the same vapour in sequence.

The apparatus may comprise a feedback arrangement operable to control the material processing. The feedback arrangement may comprise a measuring instrument operable to measure a property of the material and produce a signal proportional to the measurement, and control means operable in response to the signal to control the material processing. The control means may be operable to control the liquid jet device, a speed of the material and/or a heating step.

The jet device may be arranged in a filament spinning apparatus, and may be arranged in the path of a plurality of yarns. The jet device may be disposed downstream of a further cooling arrangement. The further cooling arrangement may be a fluid cooling arrangement in which the material passes through a fluid to be cooled by heat transfer thereto.

BRIEF DESCRIPTION OF THE DRAWINGS

The invention will now be described with reference to the accompanying drawings in which.

DETAILED DESCRIPTION OF THE PREFERRED EMBODIMENT

Figure 1:
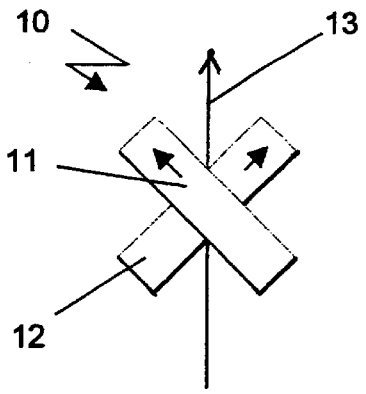
FIG. 1 is a schematic diagram of a water jet twisting device.
Figure 2:
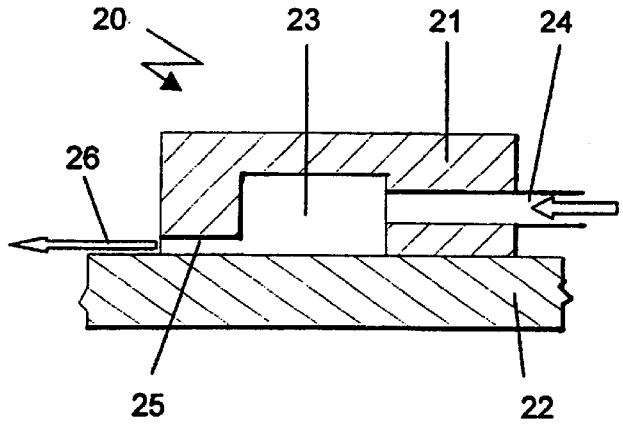
FIG. 2 is a cross-section of a water 'belt' jet.
Figure 3:
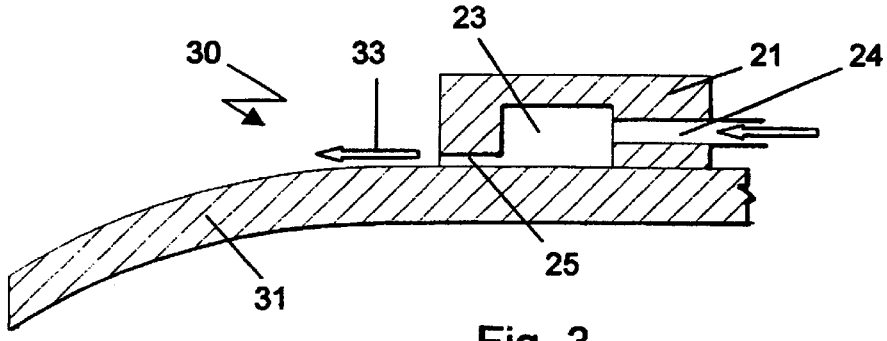
FIG. 3 is a cross-section of an alternative water 'belt' jet.
Figure 4:
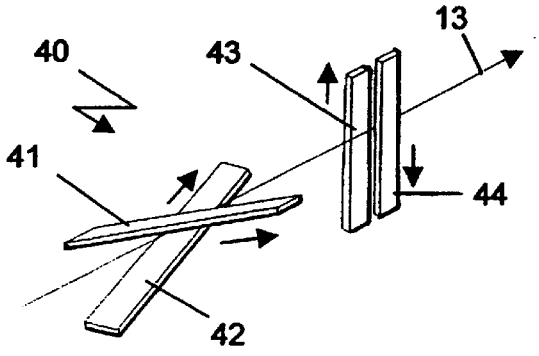
FIG. 4 is a schematic diagram of a four 'belt' jet twisting device.

Referring now to FIG. 1, there is shown schematically a water jet device 10 in which two jets or water 'belts' 11, 12 cross on opposed sides of a running yarn 13, the belts 11, 12 and the yarn 13 moving in the directions shown by the arrows. The belts 11, 12 act to twist the yarn 13 and at the same time forward the yarn 13. This action is similar to that of conventional crossed belt twisting devices. To generate each of the belts 11, 12, as shown in FIG. 2, a water belt jet 20 has a top block 21 and a bottom plate 22. High pressure water is introduced into the interior 23 of the block 21 through an inlet 24, and passes out of the chamber 23 through an outlet 25 in the form of a water 'belt' 26. The belt 26 is brought into contact with the yarn 13 by moving the block 21 adjacent the yarn 13. For easier water removal, a water belt jet 30 may have the bottom plate 31 curved as shown in FIG. 3. The water belt 33 adheres to the surface of the bottom plate 31 due to Coanda effects, and in consequence is more easily brought into precise contact with a small diameter yarn 13. In FIG. 4 there is shown schematically a four belt water jet device 40. In this case there are two belts 41, 42 which act in the same manner as belts 11, 12 of FIG. 1. Spaced from the belts 41, 42 along the yarn 13 are two further belts 43, 44. Such an arrangement controls and holds the yarn 13 in position better than the device 10, in which there may be a tendency for the yarn 13 to vibrate and thereby be of reduced quality.

Figure 6:
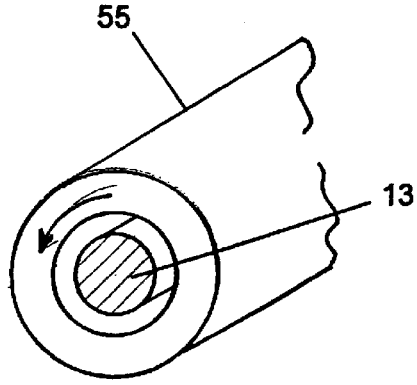
FIG. 6 shows the water 'wrapped' around the yarn in the device of FIG. 5.
Figure 5:
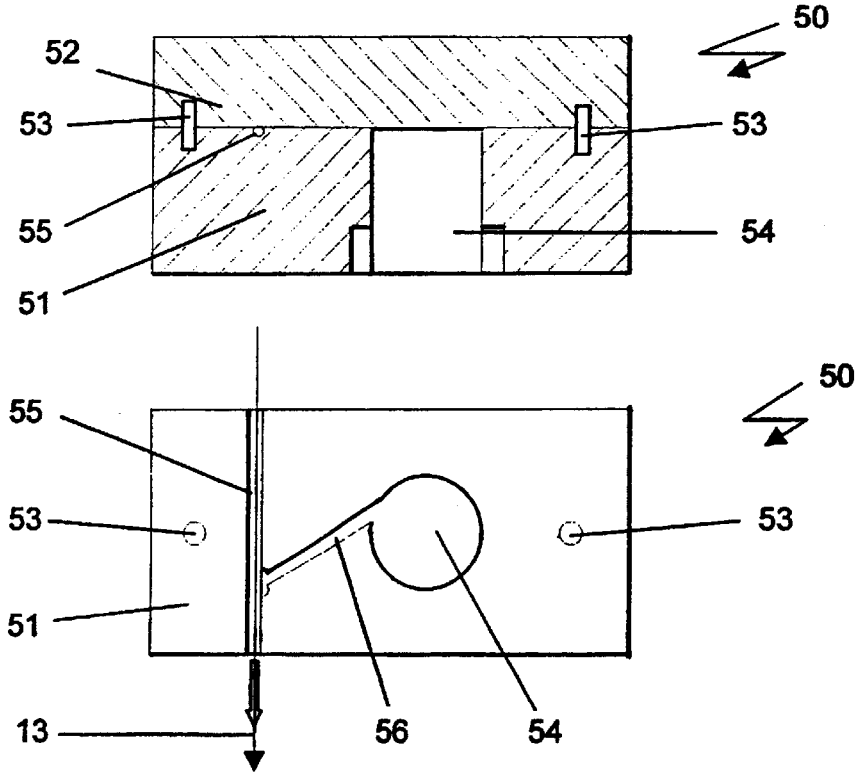
FIG. 5 is a cross-section and plan of a 'wrap' jet twisting device.
Figure 7:
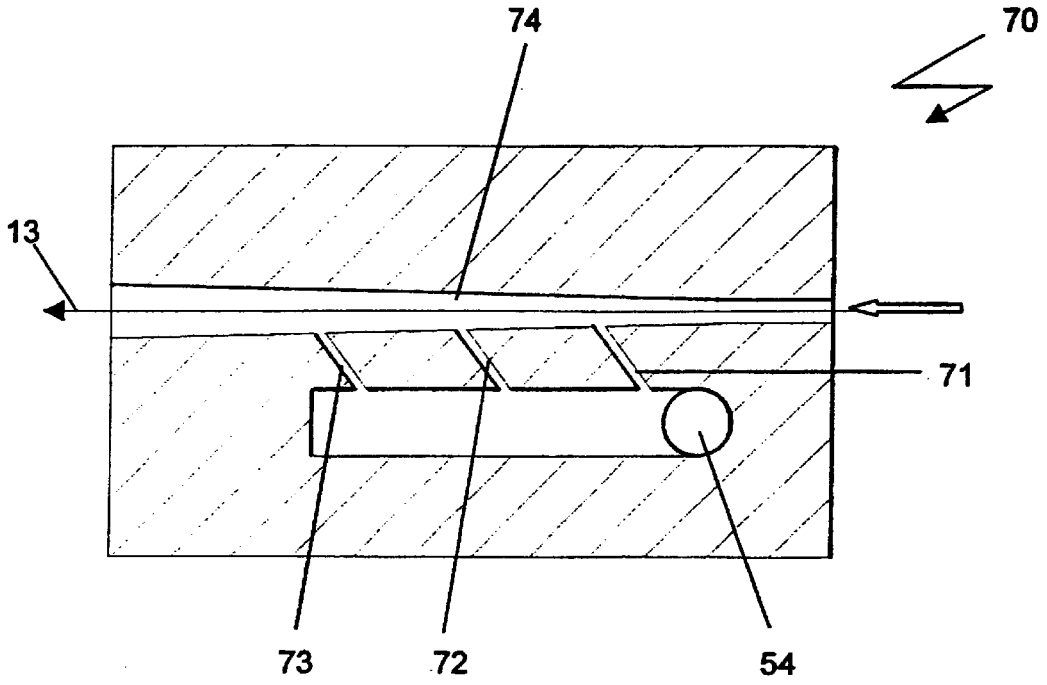
FIG. 7 shows a 'wrap' jet twisting device with a conical yarn passage.
Figure 8:
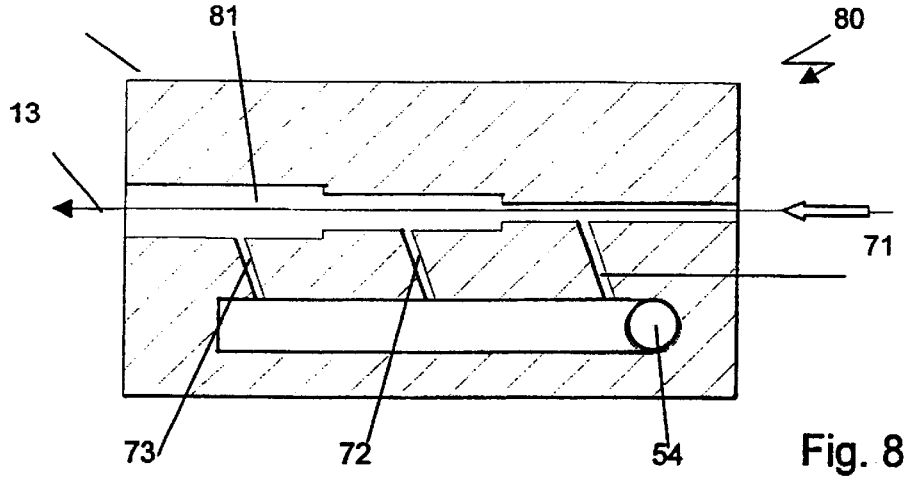
FIG. 8 shows a 'wrap' jet twisting device with a stepped yarn passage.
Figure 9:
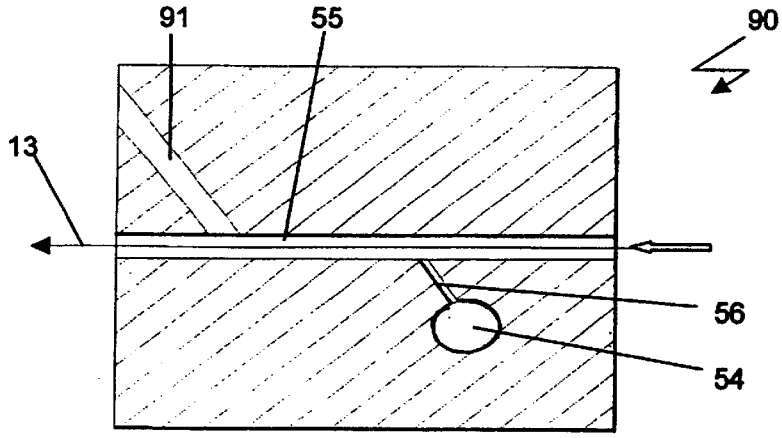
FIG. 9 shows a 'wrap' jet twisting device with a separate water exit channel.

In FIG. 5 there is shown an alternative form of water jet device 50. The jet device 50 consists of a base 51 and a lid 52. These are located in contact with each other by locating pins 53. A high pressure water inlet 54 and a yarn passage 55 are provided in the base 51. Connecting the water inlet 54 and the yarn passage 55 is a water channel 56. The water belt emerging from the water channel 56 impinges on the yarn 13 tangentially so as to create a vortex and wrap itself around the yarn 13 several times as it passes along the yarn passage 55 as shown in FIG. 6. This arrangement provides a very efficient twisting unit. More than one water channel 71, 72, 73 may intersect the yarn passage 74 as shown in the jet device 70 in FIG. 7. In this case the yarn passage 74 is of conical form so that the increased diameter along the yarn passage 74 can accommodate the increase in the volume of water as each water belt emerges therein. As an alternative to the conical form of yarn passage 74, a stepped yarn passage 81 may be provided in the jet device 80 of FIG. 8. Such a yarn passage 81 is easier to machine than yarn passage 74. In the jet device 90 of FIG. 9, there is provided a water exit channel 91 separate from the yarn passage 55 to facilitate water removal.

Figure 10:
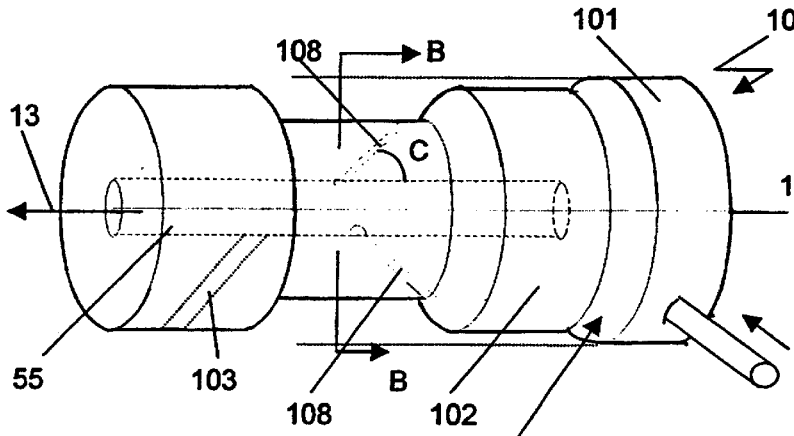
FIG. 10 shows a cylinder jet twisting device.
Figure 11:
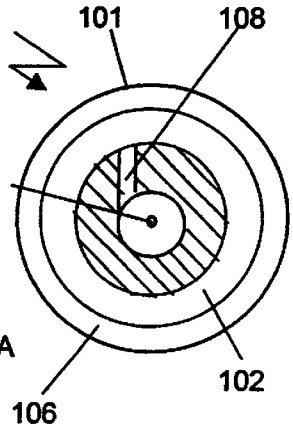
FIG. 11 is a section on the line B—B of FIG. 10 of the cylinder jet device.

Referring now to FIGS. 10 and 11, there is shown a liquid jet device 100 in the form of a cylindrical housing 101 having an insert 102 in which there is a bore 55 defining an axial path for the yarn 13 to pass through the jet 100. The bore 55 may be conical as bore 74 of FIG. 7 or stepped as bore 81 of FIG. 8. Water or other suitable liquid is supplied in the direction of arrow A to the annular space 106 between the housing 101 and the insert 102. In the insert 102 are water channels 108 which are tangential to the bore 55, two such water channels 108 being shown in this case symmetrically disposed around the yarn 13. The water channels 108, being offset from the axis of the bore 55, provide that the impinging jets of water subject the yarn 13 to a torque, which false twists the yarn 13. The water channels 108, which may be straight as shown or may be formed spirally in the insert 102, are directed at an angle to the direction of running of the yarn 13 so that the water jets have components of velocity along the path of the yarn 13 as well as laterally thereof. This applies a forwarding force to the yarn 13 as well as the false twisting torque. The greater the cone angle C, the more is the twisting torque and the less is the forwarding force and vice versa. The water may exit from the insert 102 in the direction of arrow B through an outlet 103 if provided. More than one such water outlets 102 may be provided, each substantially in alignment with one of the water channels 108.

Figure 12:
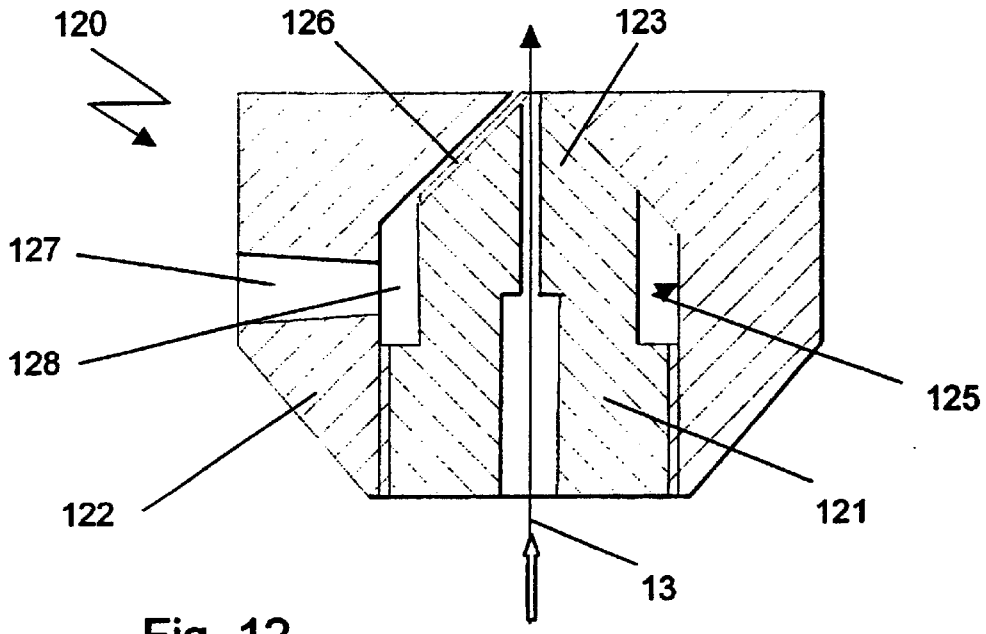
FIG. 12 is a section through a miniature twist jet.

In FIG. 12 there is shown a miniature twist jet 120 that operates in a similar manner to jet 100. In this case an insert 121 is located in a housing 122. The insert 121 has a conical end 123 that co-operates with a conical end 124 to the bore 125 of the housing 122. In the conical end 123 of the insert 121 are one or more grooves 126 forming a water channel. Water is introduced into the housing 122 through inlet 127, and passes to an annular space 128 between the insert 121 and the bore 125. The water then flows through the water channel or channels 126 to impinge on the yarn 13 as it passes through the jet device 120.

Figure 13:
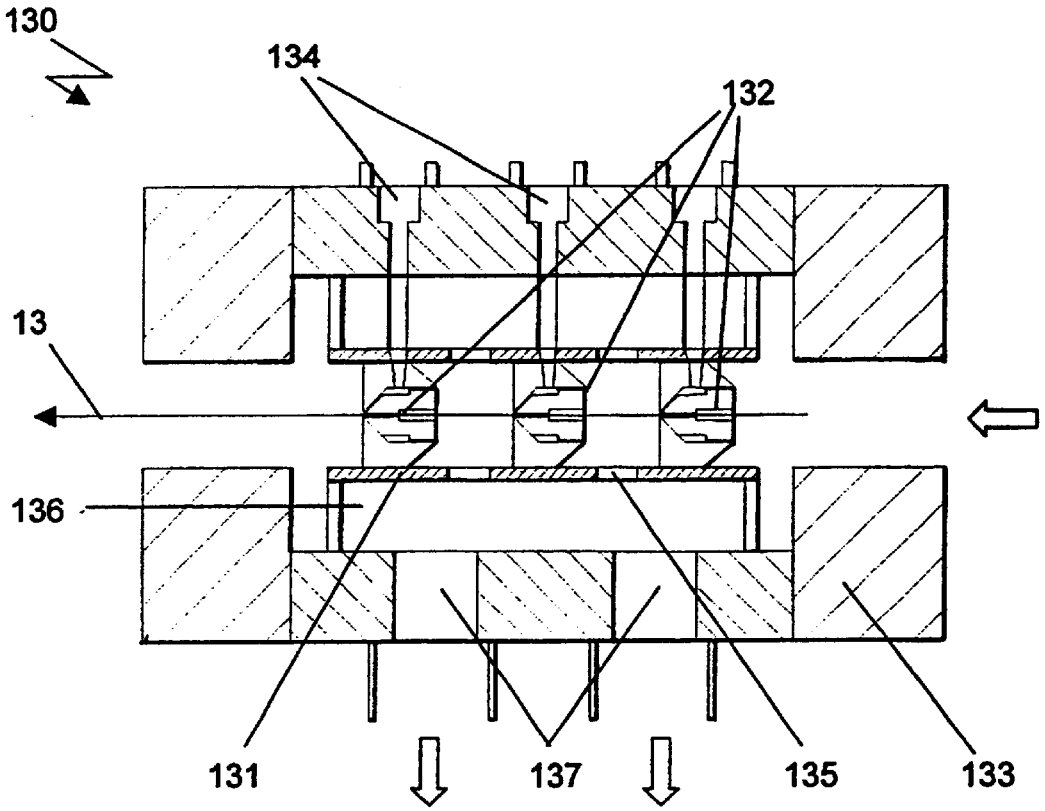
FIG. 13 shows a multi-jet assembly.

Referring now to FIG. 13, there is shown a multi-head false twist unit 130. Within a housing 131 are three axially aligned liquid jet devices 132 similar to the type shown in FIG. 12 and mounted in a casing 133. Water is introduced to each of the jets 132 through the casing 133 and housing 131 by high-pressure inlets 134. The water, having impinged on the yarn 13 running successively through the three jet devices 132, exits from the housing 131 through drain holes 135 into the annular space 136 between the casing 133 and the housing 131. Water outlets 137 are provided in the housing 131. The use of the multi-head apparatus 30 provides that each successive jet device 32 augments the twist in the yarn 14 inserted by the previous jet device 32. The cone angles of the cones 17 of the three jet devices 32 may be progressively smaller whereby the first jet device 32 imparts more twisting torque and less forwarding force and the later jet devices 32 impart successively less twisting torque and greater forwarding force to the yarn 14.

Figure 14:
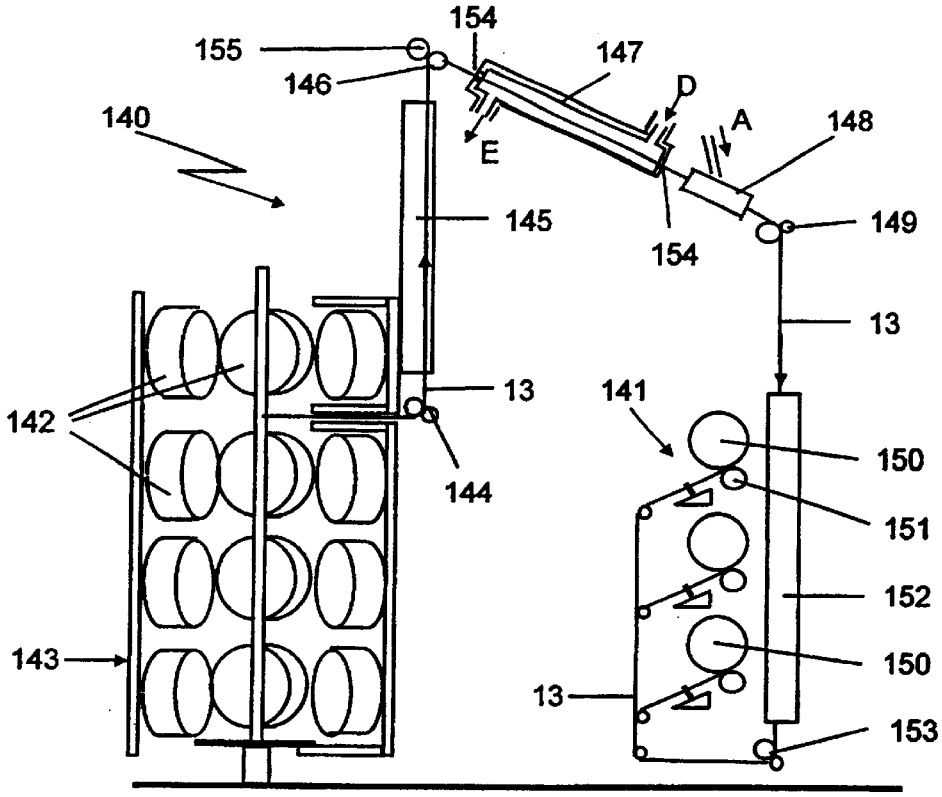
FIG. 14 shows a conventional false twist texturing machine.

A conventional false twist texturing machine arrangement 140 is shown in FIG. 14. Typically the yarn 13 is partially drawn and is supplied on supply packages 142 mounted in a creel 143. The yarns 13 are withdrawn from the packages 142 by a first feed roller pair 144 and fed to a primary heater 145, and then around a guide roller 146 to a cooling device 147. From the cooling device 147 the yarn 13 passes through a false twist device 148 and a second feed roller pair 149. The false twist device 148 imparts a false twist to the yarn 13 which twist runs back to the first feed rollers 144, these acting as a twist stop device. The heating device 145 heats the twisted yarn 13, which retains the twist memory as it is cooled in the cooling device 147. The thus textured stretch yarn 13 may be passed directly to a take up arrangement 141 in which it is wound onto a bobbin 150 driven by surface contact with a driving bowl 151. Alternatively the textured yarn 13 may be passed through a setting or second heater 152 to become set yarn before passing to the take-up arrangement 141. In this case, a third feed roller pair 153, which forwards the set yarn 13 to the take-up arrangement 141, is driven at a lower peripheral speed than that of the second feed rollers 149 so that the heating of the textured yarn 13 in the second heater 152 is at a controlled overfeed.

In the case of this invention, the false twisting device 148 is constructed and operates as the device 50, 70, 80, 90, 100, 120 or 130 as described above, with water being introduced into the false twist device 148 in the direction of arrow A. The cooling device 147 is a cylinder through which the heated yarn 13 passes and into which cooling water is introduced in the direction of arrow D and from which the water exits in the direction of arrow E. With this arrangement, the cooling water passes along the cooling device 147 in turbulent contraflow to the running yarn 13, both of which factors enhance the transfer of heat from the yarn 13 to the cooling water. At the opposed ends of the cooling device 147, the yarn inlet and yarn outlet are provided with labyrinth seals 154 which can be pressurised against escape of water, for example by compressed air.

Conventionally, the heater 145 is a relatively long plate at a temperature close to the melting temperature of the yarn 13 and in contact with which the yarn 13 runs. Alternatively, to reduce the overall size of the machine 140, the primary heater may be a short non-contact heater at a temperature considerably higher than the melting temperature of the yarn 13. As an alterative the roller 146 may be heated in order to heat the yarn 13 as it passes therearound. However, in this case the primary heater 145 is a vapour-heating chamber through which the yarn 13 runs, the preferred vapour being pressure steam. A further roller 155 is disposed to combine with the guide roller 146 to form the twist stop that inhibits twist from running upstream of the rollers 146, 155. The untwisted yarn 13 is more receptive to heat transfer than twisted yarn, so that the heater 145 may be smaller than even the short high temperature heaters referred to above. The peripheral speed of the rollers 146, 155 is greater than that of the first feed rollers 144 so that the heated yarn 13 is drawn between them. The yarn 13 is heated sufficiently by the steam in heater 145 prior to passing through the twist stop rollers 146, 155 that no further heating is required between the twist stop rollers 146, 155 and the false twist device 148. The heat in the yarn 13 is sufficient as it passes into the cooling device 147 for the yarn 13 to retain its twist memory. Due to the turbulent contraflow of cooling liquid in the cooling device 147, this cooling device 147 is shorter than conventional free-air or plate contact cooling arrangements.

Figure 15:
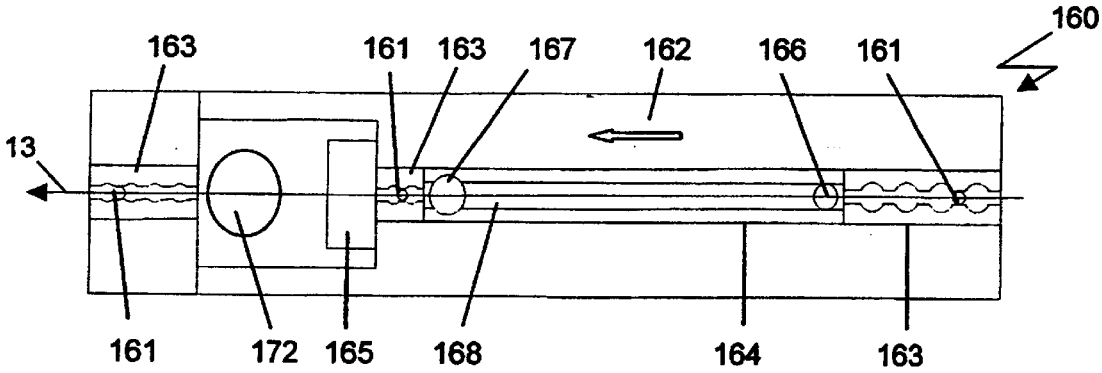
FIG. 15 is a section through an all-in-one jet device.
Figure 16:
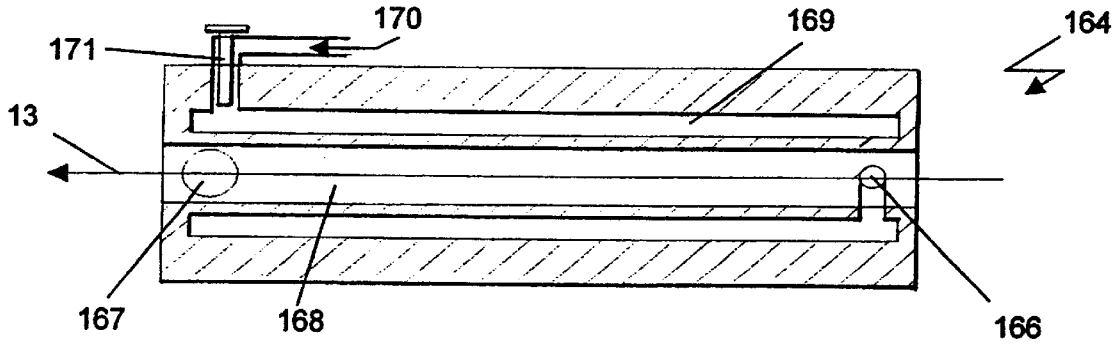
FIG. 16 is an enlarged view of the heater part of the jet device of FIG. 15.

Referring now to FIGS. 15 and 16, there is shown an all-in-one jet device 160. The jet device 160 fulfils the role of the heater 145, cooling device 147 and false twist device 148 of the machine 140 described above.

The primary heating, cooling and false twisting device 160 comprises a housing 162 having labyrinth seals 163 at the entrance and exit for the yarn 13. The labyrinth seals 163 are pressurised, to prevent water egress from the interior of the housing 162, by compressed air supplied through inlets 161. Within the housing 162 is, in sequence, a primary heating apparatus 164 and a cooling and twisting apparatus 165. The heating apparatus 164 has a steam inlet 166 and a steam outlet 167, the yarn 13 being heated by the steam as it passes along the heating chamber 168 of the heating apparatus 164. A manifold 169 surrounds the heating chamber 168 to provide supplementary heating, the manifold 169 being supplied through inlet 170. A supplementary heater 171 may be provided in the steam inlet 170 to ensure the maximum heating of the yarn 13 in the heater 164, thereby reducing the length of heater 164 required. The cooling and false twisting device 165 shown is a single head apparatus such as devices 50, 70, 80, 90, 100 or 120 described above, but preferably a multi-head apparatus 130 as shown in FIG. 13 is provided in order to increase the twist level imparted to the yarn 13. As the heated yarn 13 passes into the cooling and false twisting device 165 it is cooled due to the effect of the cold water passing through the device 165. The jets of water impinging laterally on the yarn 13 impart a false twist to the yarn 13. The water passes out of the cooling and false twisting device 165 through a water drain 172. This twist runs back through the heating apparatus 164 to the first feed rollers 144, these acting as a twist stop device. The heating device 164 heats the twisted yarn 13, which retains the twist memory as it is cooled in the cooling and twisting device 165. A further labyrinth seal 161 may be provided between the heating device 164 and the cooling and twisting device 165 if required.

Figure 17:
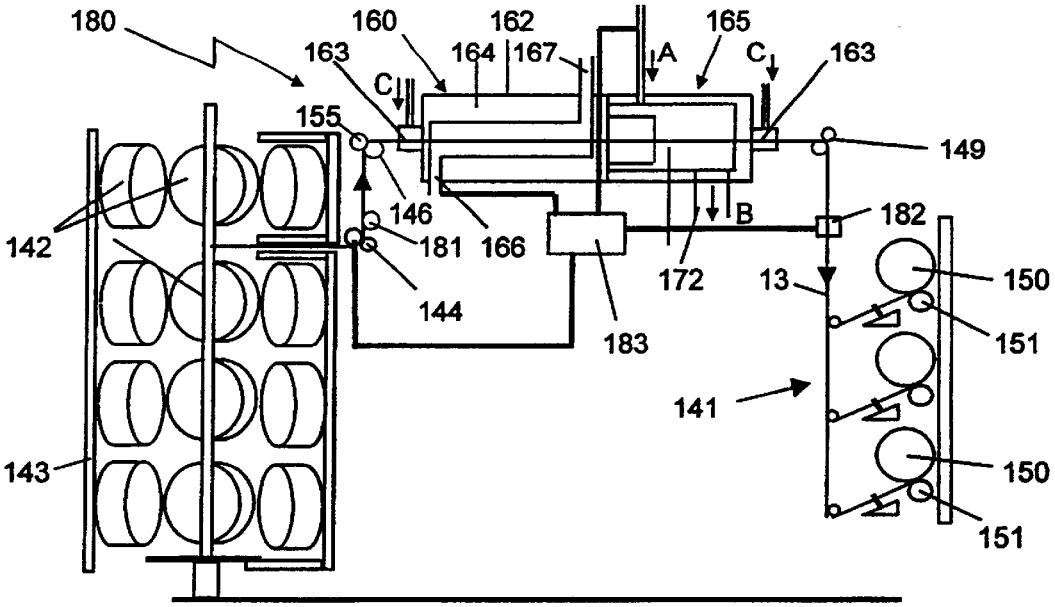
FIG. 17 is alternative embodiment of false twist texturing machine.

Referring now to FIG. 17, there is shown a false twist texturing machine 180 having many of the components as described in respect of machine 140 of FIG. 14. The corresponding components are identified by the same reference numerals. In this arrangement, heating for drawing the yarn 13 between the first feed rollers 144 and the rollers 146, 155 is provided by a heated draw pin 181. The heating, cooling and false twisting device 160 has labyrinth seals 163 at the entrance and exit for the yarn 13, the seals 163 being pressurised to prevent water egress from the interior of the housing 162, by compressed air supplied in the direction of arrows C. Within the housing 162 is, in sequence, a heating apparatus 164 and a cooling and twisting apparatus 165. The heating apparatus 164 has a steam inlet 166 and a steam outlet 167, the yarn 13 being heated by the steam as it passes through the heating apparatus 164. The cooling and false twisting apparatus 165 shown is a single head device such as devices 50, 70, 80, 90, 100 or 120 described above, but preferably a multi-head apparatus 130 as shown in FIG. 13 is provided in order to increase the twist level imparted to the yarn 13. As the heated yarn 13 passes into the cooling and false twisting apparatus 165 it is firstly cooled, due to the effect of the cold water passing through the apparatus 165. The jets of water impinging laterally on the yarn 13 impart a false twist to the yarn 41. This twist runs back through the heating apparatus 164 to the feed rollers 146, 155, these acting as a twist stop device. The heating device 164 heats the twisted yarn 13, which retains the twist memory as it is cooled in the cooling and twisting device 165.

Another significant difference between the machines 140 and 18 is that in the case of machine 180 there is shown a measuring instrument 182 which measures a property of the stretch yarn 13. Such parameter may be elasticity or crimp modulus. The measuring instrument 182 sends a signal proportional to the value of the measured parameter to a controller 183 which compares that value with a predetermined desired value. If there is a discrepancy between the two values the controller 183 is operable to control the rate and pressure of the water flow to the false twist apparatus 165, the speed of the feed rollers 144, 146, 155, 149 and/or the temperature of the heating apparatus 164. The machine 180 may have a second post treatment or setting heater 152 as shown in FIG. 14. The textured yarn 13 runs through the secondary heater 152 under controlled overfeed conditions between second feed rollers 149 and third feed rollers 153 to receive its setting heating. The set yarn 13 then passes to the take-up arrangement 141. The steam issuing from the primary heater 164 is passed to the secondary heater 152, being further heated or cooled as required under the control of the controller 183 in response to the signal from the measuring instrument 182 which in this case measures a parameter of the set yarn 13.

Although the embodiments of false twisting apparatus shown are fixed units, the individual jets of water may be individually mounted in the housing so that each is adjustable in respect of its spacing from the axis of the yarn 13 to increase or decrease the twisting torque provided by a specific size of jet of water.

Figure 18:
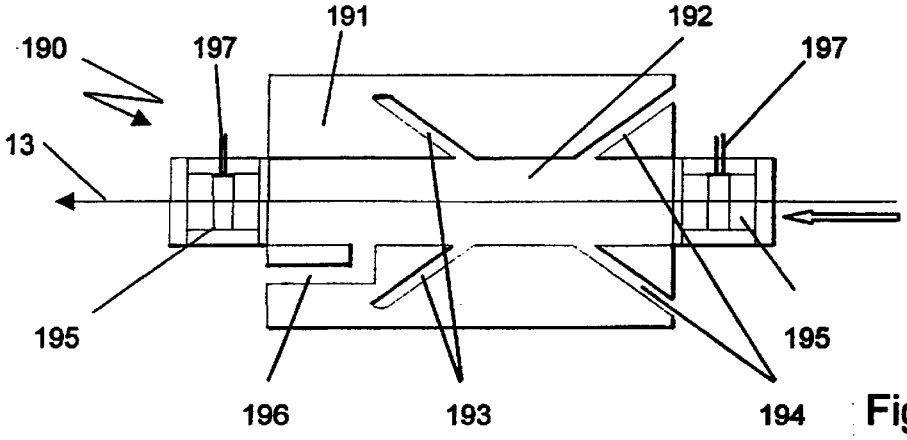
FIG. 18 is a longitudinal section of a texturing slot jet device.

In FIG. 18, there is shown a texturing slot jet device 190 in the form of a cylindrical housing 191 having a texturing chamber 192 defining an axial path for a multifilament yarn or yarn product 13 to pass through the jet 190. Opening into the texturing chamber 192 are inlets 194, two being shown in this case disposed around the yarn product 13, for water or other suitable liquid provided from a source (not shown). Aligned with each inlet 194 on the opposite side of the texturing chamber 192 is a resonance chamber 193. The openings of the inlets 194 are transverse to the axis of the texturing chamber 192 so that the impinging jets of water are transverse to the running yarn product 13 and subject the yarn product 13 to an agitating force. The inlets 194 are directed at an angle to the direction of running of the yarn product 13 so that the water jets have components of velocity axially of the yarn product 13 as well as transversely thereof. This applies a forwarding force to the yarn product 13 as well as the transverse force. Alternatively the inlets 194 could be inclined in the reverse direction to apply a retarding force to the yarn product 13. The supply of water to the inlets 194 may be pulsed to produce a more even form of texturing or other desired effect. At each end of the housing 191 is an annular labyrinth seal 195 to prevent escape of water from the texturing chamber 192 along the path of the yarn product 13, the water exiting from the texturing chamber 192 through a water drain 196. The seals 195 may be pressurised by gas, e.g. compressed air, from a source (not shown) through inlets 197.

Figure 19:
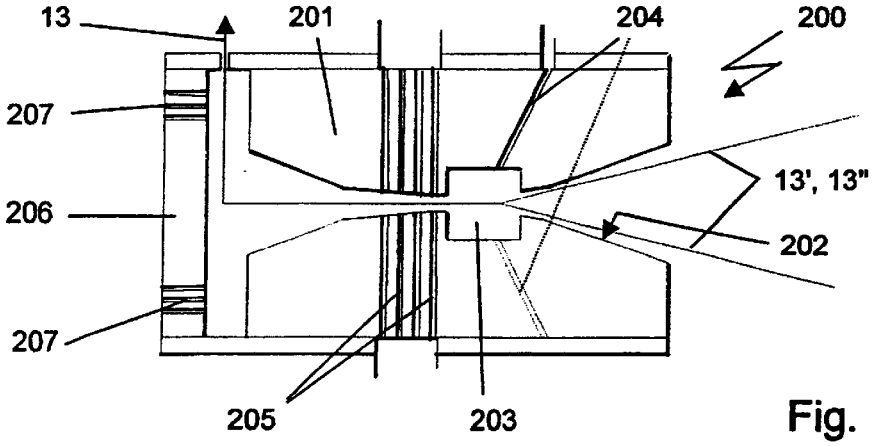
FIG. 19 shows a three hole intermingling jet device.
Figure 20:
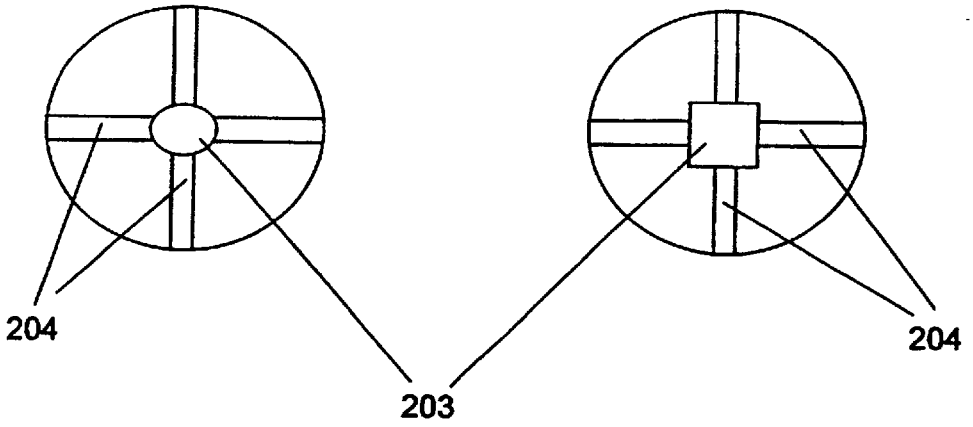
FIG. 20 shows cross sections through two four hole jet devices similar to that of FIG. 19.

FIG. 19 shows a three hole intermingling jet device 200 to which two yarns 13*a*, 13*b* are introduced to form a single intermingled/textured yarn 13. The jet device 200 is formed from a block 201 having a conical entry 202 for the yarns 13', 13". The entry 202 leads to an intermingling chamber 203 into which the three water jets 204 are directed. The jets 204 impinge substantially axially on the combined yarns 13 to intermingle/texture their filaments or fibres. After the intermingling, the water passes from the jet device 200 through radial drain outlets 205. The yarn 13 is forwarded to a baffle plate 206 at which it is retarded and redirected to pass from the jet device 200 in a radial direction. The retardation reduces the tension in the yarn 13 to assist in allowing a good level of intermingling to occur. Since some water will be entrained with the yarn 13, forward drains 207 are provided in the baffle plate 206. To reduce the insertion of twist, an even number of water jets 204 are more suitable than the three hole version of FIG. 19. Suitable arrangements are shown in cross section in FIG. 20, in which four water jets 204 are provided. The cross section of the intermingling/texturing chamber 203 may be circular or square as shown.

Figure 21:
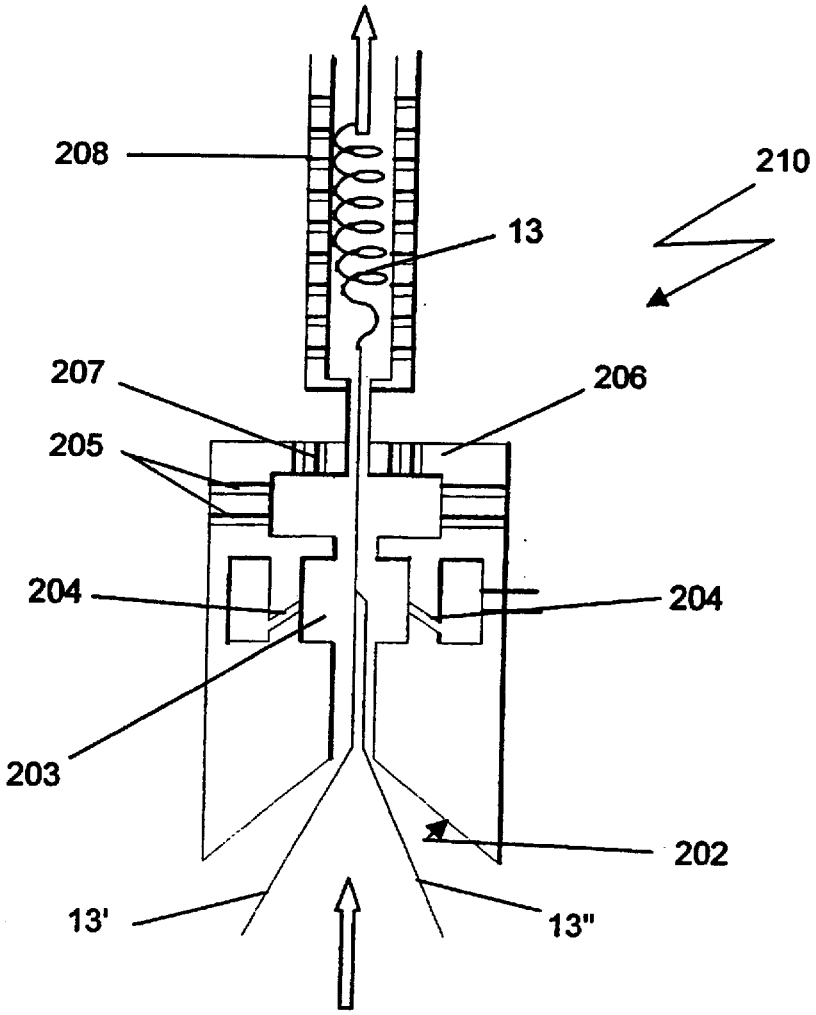
FIG. 21 shows a texturing jet device with a plug former.

As an alternative to the change of direction of the yarn 13 at the baffle plate 206 of the previous embodiment, the yarn 13 may be retarded by being formed into a plug as shown in FIG. 21. In this embodiment, the texturing/intermingling jet 210 is similar to jet device 200 up to the texturing/intermingling chamber 203 to which two yarns 13', 13", for example a core yarn 13' and an effect yarn 13", are forwarded. However, after texturing/intermingling, the yarn 43 passes through the end plate 207 into a plug former 208. In the plug former 208 the forward motion of the yarn 13 is resisted by the mass of yarn 13 already accumulated in the forward former 208. By this means, the forward thrust of the jet 210, which creates a high yarn tension in the jet 210, is reduced to zero, and high tensions are inimical to obtaining good interlacing and loop locking. Water is more efficient than air in both forwarding the yarn 13 and intermingling. Achieving the proper balance between the two functions is important.

Figure 22:
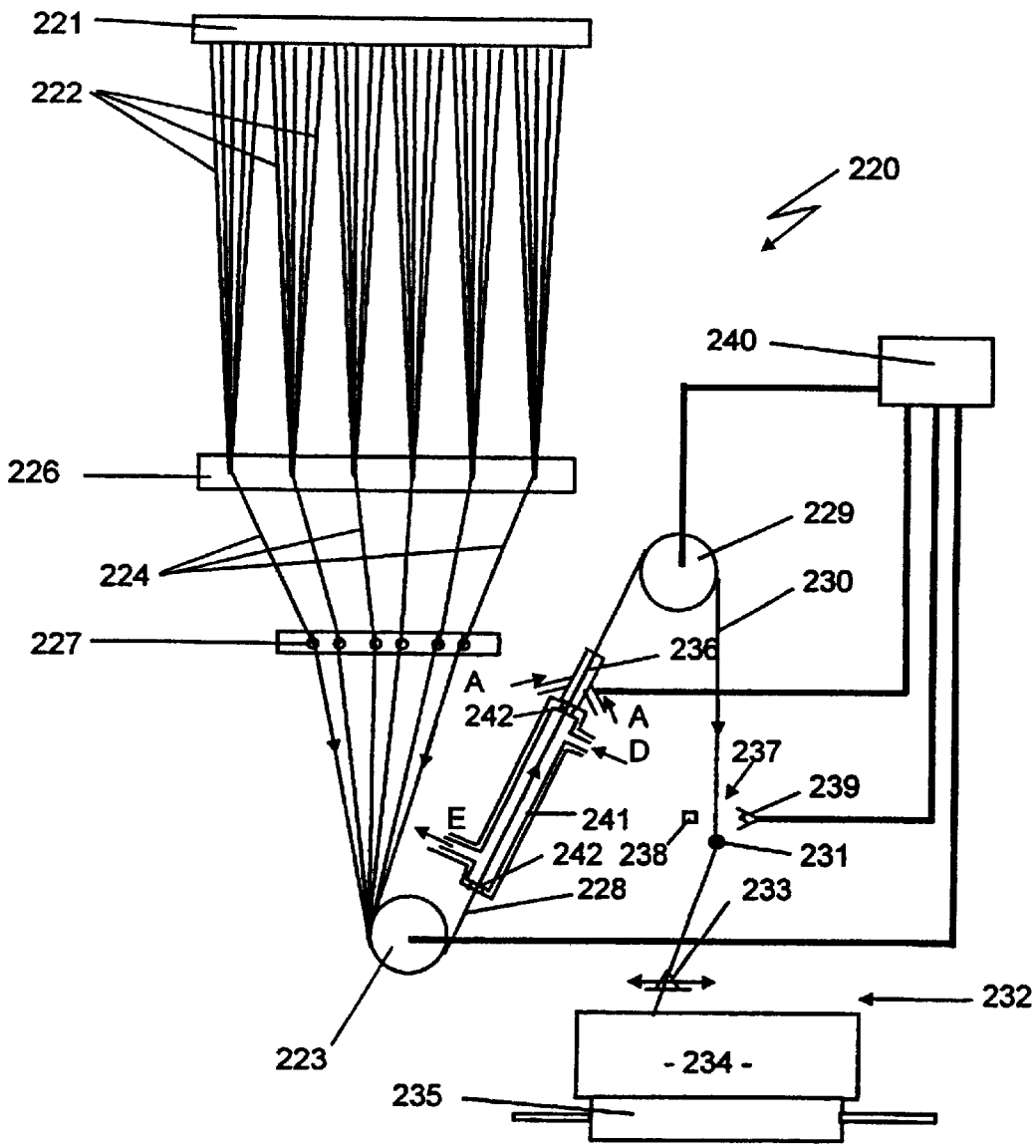
FIGS. 22 and 23 are threadline diagrams of alternative filament spinning apparatus incorporating the jet devices of FIGS. 18 to 21.

Referring now to FIG. 22, there is shown a filament spinning apparatus 220 having a spinning head 221 from which filaments 222 are extruded. The filaments 222 are withdrawn from the spinning head 221 by a first feed roller 223. Spin finish oil is applied to the filaments 222 by an oil applicator 226, at which the filaments 222 are brought together to form yarns 224, and the regularity of the oil application is improved by oil dispersion jets 227. The yarns 224 are drawn between the spinning head 221 and the first feed roller 223, and the resulting partially oriented yarn 228 is forwarded to a second feed roller 229. An intermingling jet 236, which directs a jet of liquid at the yarn 228 to intermingle the filaments of the yarn 228, is disposed in the controlled tension zone between the first and second feed rollers 223, 229, but may be placed before the roller 223. The interlaced yarn 230 is passed through an optical interlace sensor 237 to a forwarding point 231. The interlaced partially drawn yarn 230 is then fed from the forwarding point 231 to a take up zone 232 to be wound using a traverse guide 233 onto a package 234 driven by surface contact with a driving bowl 235. The traverse guide 233 reciprocates as shown along a path parallel with the axis of the package 234. The interlace sensor 237 comprises an optical transmitter 238 and an optical receiver 239, a beam from the transmitter 238 being directed at the yarn 230 and then being received by the receiver 239. The receiver 239 sends to a control device 240 a signal that varies in response to the changes in dimension of the intermingled yarn 230, i.e. as interlace nodes pass the sensor 238. The control device 240 is operable to control the supply and/or pressure of liquid to the intermingling jet 236 and/or the speed of the feed rollers 223, 229, and that supply may be pulsed if desired.

Figure 23:
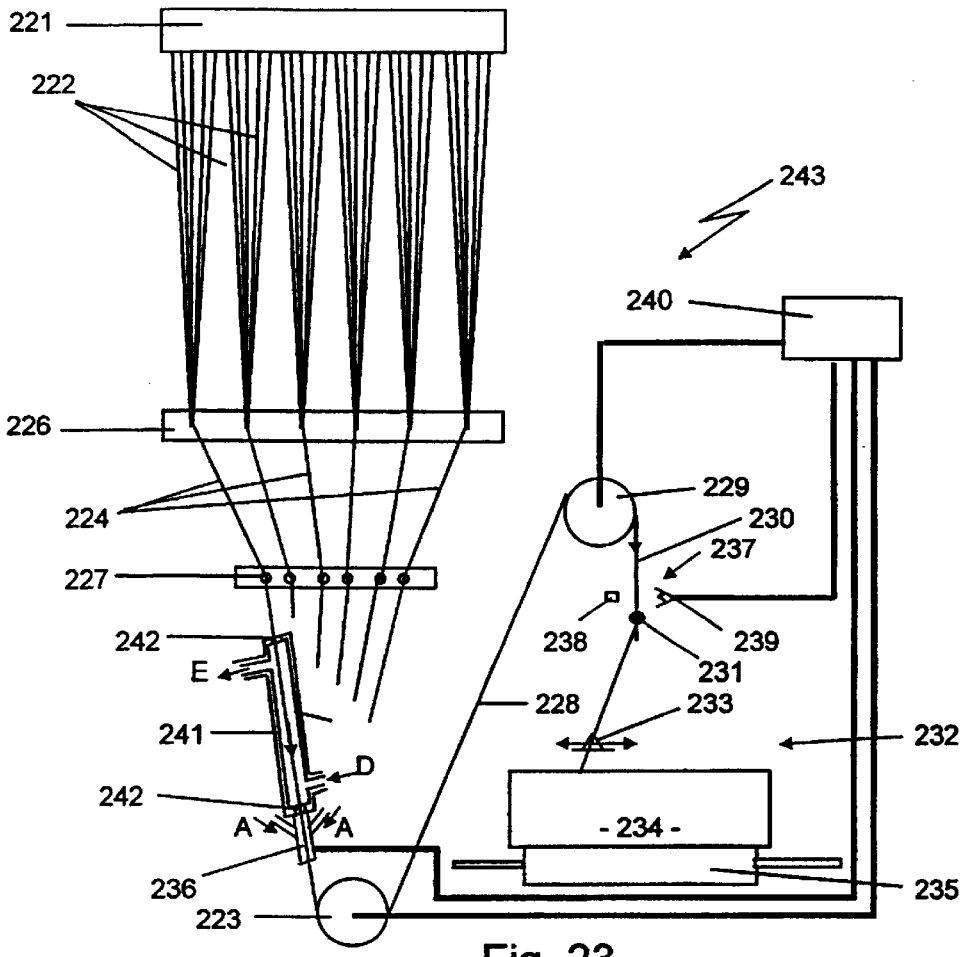

In the case of this invention, the intermingling jet 236 is constructed and operates as the device 190, 200 or 210 of FIGS. 18 to 21, with water being introduced into the intermingling jet 236 in the direction of arrows A as described above. Conventionally, the distance between the spinning head 221 and the first feed roller 223, the cooling chimney, is a relatively long so that the yarns 224 have cooled to a temperature at which they can be subjected to the intermingling step in the jet 236. However, since the water supplied to the jet 236 is cold, thereby cooling the drawn yarn 228, this may provide sufficient cooling for a significant reduction in the height of the cooling chimney whilst allowing the satisfactory intermingling of the filaments of the yarn 228 by the jet 236. Alternatively, a further cooling device 241 may be placed in the threadline between the feed roller 223 and the intermingling jet 236. The cooling device 241 is a cylinder through which the yarn 228 passes and into which cooling water is introduced in the direction of arrow D and from which the water exits in the direction of arrow E. With this arrangement, the cooling water passes along the cooling device 241 in turbulent contraflow to the running yarn 228, both of which factors enhance the heat transfer from the yarn 228 to the cooling water. At the opposed ends of the cooling device 241, the yarn inlet and yarn outlet are provided with labyrinth seals 242 which can be pressurised against escape of water therethrough as described in respect of seals 195 of the texturing jet 190. The intermingling jet 236 and the cooling device 241 are shown as contiguous, and the cooling water may pass directly from one to the other. As a further alterative, and provided that the tension in the yarns 224 is not too great, the cooling device 241 and intermingling jet 236 may be disposed between the oil dispersion jets 227 and the first feed roller 223 to further reduce the height of the cooling chimney, as shown in machine 243 in FIG. 23. Only one of the yarns 224 is shown passing through the respective cooling device 241 and intermingling jet 236 for clarity.

Figure 24:
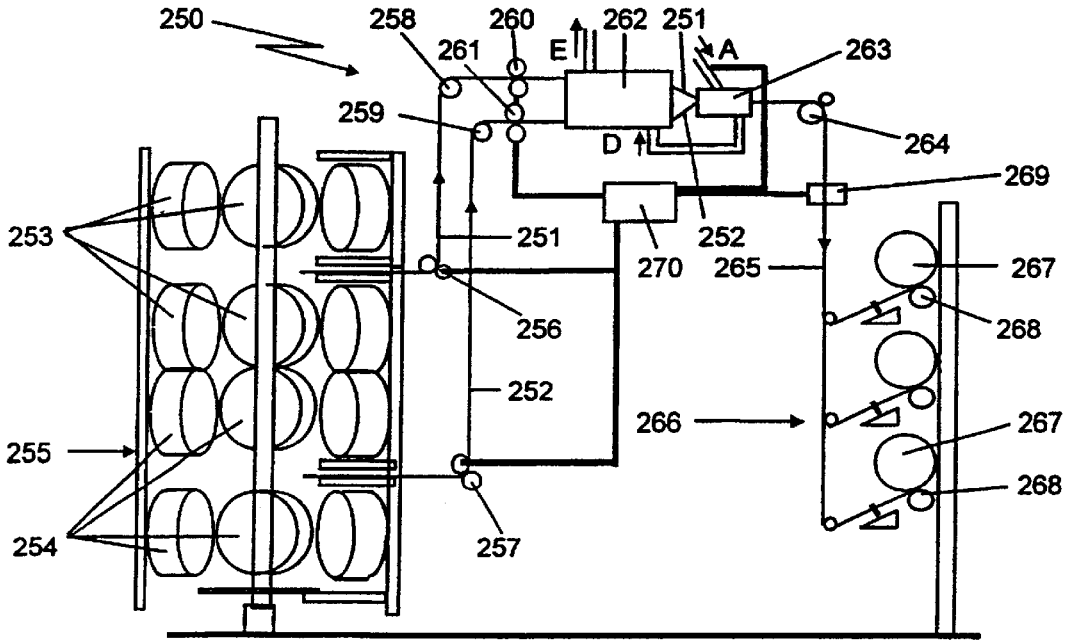
FIG. 24 is a yarn co-mingling machine incorporating the jet devices of FIGS. 18 to 21.

A machine 250 for co-mingling two or more yarns is shown in FIG. 24, in this case two textile yarns 251, 252. The yarns 251, 252, which may be the same as but are more usually different from each other, for example one may be a staple yarn, are supplied on respective supply packages 253, 254 mounted in a creel 255. The yarns 251, 252 are withdrawn from the packages 253, 254 by first feed roller pairs 256, 257 and fed along parallel tracks to respective heated rollers or draw pins 258, 259 to respective draw rollers 260, 261 and to a cooling device 262. From the cooling device 262 the yarns 251, 252 pass through a co-mingling device 263 to a second feed roller pair 264. The peripheral speed of the draw rollers 260, 261 is greater than that of the first feed rollers 256, 257 so that the yarns 251, 252 are drawn at the draw rollers or pins 258, 259, and the peripheral speed of the second feed rollers 264 is controlled relative to that of the draw rollers 260, 261 so that the tension in the yarns 251, 252 is controlled for satisfactory co-mingling of the yarns 251, 252. The yarns 251, 252 may be drawn to differing amounts, or one of the yarns may be forwarded directly from the feed rollers 256, 257 to the co-mingling device 263 so as not to be heated, drawn and cooled, as required in any particular application. Also either or both of the yarns 251, 252 may be false twisted, for example one S-twist and one Z-twist, between the feed rollers 256, 257 and the co-mingling device 263. The co-mingling device 263 agitates the yarns 251, 252 to co-mingle their filaments together to form a single coherent yarn 265. The heated rollers 258, 259 heat the yarns 251, 252 to facilitate the drawing step and any false twisting step. The thus co-mingled yarn 265 is forwarded to a take up arrangement 266 in which it is wound onto a bobbin 267 driven by surface contact with a driving bowl 268.

In this machine arrangement, the cooling device 262 and the commingling device 263 are shown to be contiguous. In addition, the water introduced into the co-mingling device 263 is forwarded therefrom to the cooling device 262 in the direction of arrow D, so that both devices 263, 262 use the same water. Also in the case of machine 250, there is shown a measuring instrument 269, which measures a property of the co-mingled yarn 265. Such parameter may be node frequency or coherence. The measuring instrument 269 sends a signal proportional to the value of the measured parameter to a controller 270 which compares that value with a predetermined desired value. If there is a discrepancy between the two values the controller 270 is operable to control the rate or pressure of water flow to the co-mingling device 263 and/or the speed of the first feed rollers 256, 257, the draw rollers 260, 261, and the second feed rollers 264.

Figure 25:
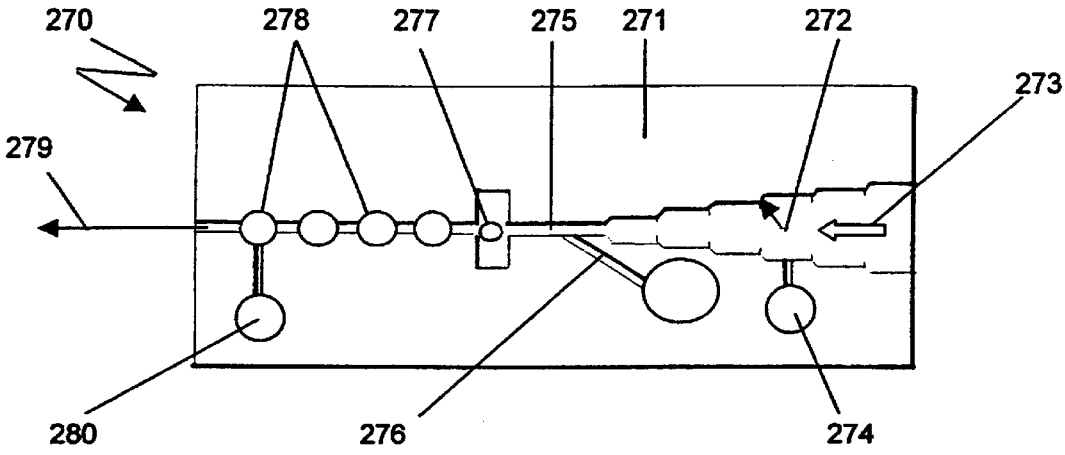
FIG. 25 is a section through a drafting and twisting jet device for staple yarns.

Referring now to FIG. 25, there is shown a drafting and twisting jet device 270 for staple products. In staple spinning it is necessary to twist and draw the sliver or roving simultaneously so as to reduce the number of fibres in the yarn cross section by drawing but to maintain the integrity of the yarn by the twist insertion. The jet device 270 is suitable for this purpose, and consists of a block 271 having labyrinth chambers 272 at the inlet for the sliver or roving 273. High pressure water is passed into the bore 275 of the jet device 270 through an inlet 276 and drains from the bore 275 through drain outlet 277. Labyrinth seals 278 are disposed along the path of the spun yarn 279 formed by the drawing and twisting effect of the water on the sliver or roving 273. To prevent water egress from the jet device 270 in the direction of the sliver or roving entry or spun yarn withdrawal, compressed air is passed into the labyrinth chambers 272 through inlet 274 and into at least the last of the labyrinth seals 278 through inlet 280.

Figure 26:
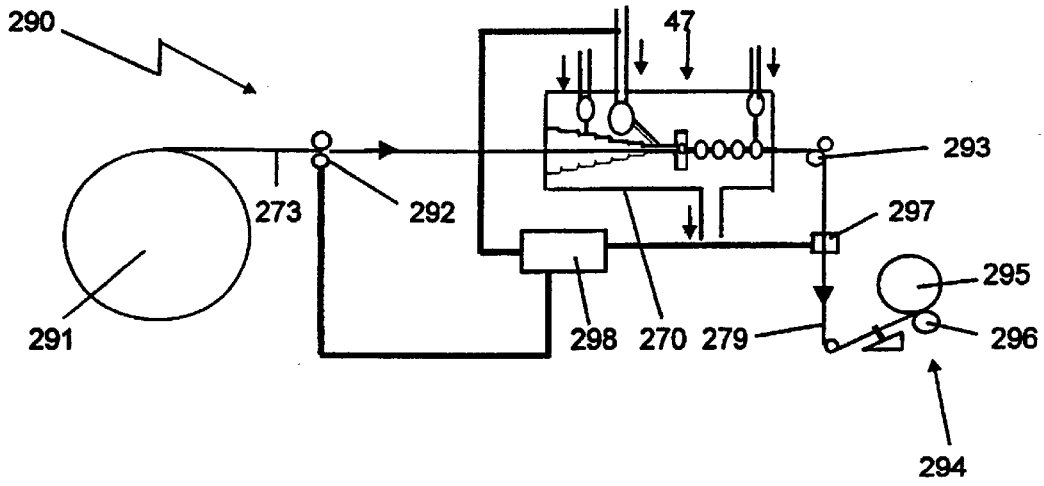
FIG. 26 shows a threadline diagram of a staple twisting machine

A staple twisting and drawing machine arrangement 290 embodying the above-described twisting device 270 is shown in FIG. 26. The supply of staple product 273 is provided in this case on a supply package 291, but the supply could be directly from a carding machine or other processing machine (not shown). A first feed roller pair 292 withdraws the product 273 from the package 291. The product 273 is then forwarded to a drawing and twisting device 270. From the drawing and twisting device 270 the resulting spun yarn 279 passes via a second feed roller pair 293 to a take up arrangement 294 in which it is wound onto a bobbin 295 driven by surface contact with a driving bowl 296. The twist device 270 imparts a false twist to the product 273 which twist traps the staple fibres to give coherence to the spun yarn 279.

A measuring instrument 297 is provided to measure a property of the spun yarn 279. Such parameter may be bulk or hairiness. The measuring instrument 297 sends a signal proportional to the value of the measured parameter to a controller 298 which compares that value with a predetermined desired value. If there is a discrepancy between the two values, the controller 298 is operable to control the rate and/or pressure of the water flow to the twisting device 270, and/or the speed of the feed rollers 292 and 293.

What is claimed is:

1. A method of twisting textile yarn material, comprising passing the material along a predetermined path through a liquid jet device applying a rotational farce to the material transversely to the axis thereof in order to impart a twist to the textile yarn material, wherein the liquid jet device has a housing with a seal for preventing escape of liquid with the twisted textile yarn material.

2. A method according to claim 1, in which the material is twisted and is cooled so as to produce a textured material.

3. A method according to claim 2, wherein the material is cooled by the liquid jet device.

4. A method according to claim 1, also comprising applying a force to the material along the axis of the material.

5. A method according to claim 4, comprising applying the at least one jet of liquid to the surface of the material transversely to the axis thereof.

6. A method according to claim 5, comprising applying the at least one jet of liquid with components of velocity both axially of and transversely to the material path through the jet device.

7. A method according to claim 1, wherein the liquid is water.

8. A method according to claim 1, wherein the supply of liquid to the liquid jet device is pulsed.

9. A method according to claim 1, wherein the material is a continuous filament yarn.

10. A method according to claim 1, wherein the seal is a labyrinth seal.

11. A method according to claim 10, wherein the seal is pressurized.

12. A method according to claim 11, wherein the seal is gas pressurized.

13. A method according to claim 12, wherein the seal is pressurized by compressed air.

14. A method for applying a false twist to a filament yarn, comprising passing the filament yarn along a predetermined path through a liquid jet device applying a rotational force to the filament yarn transversely to the axis thereof in order to impart a twist to the filament yarn material, wherein the liquid jet device has a housing with a seal for preventing escape of liquid with the filament yarn material.

15. A method according to claim 14, wherein the seal is a labyrinth seal.

16. A method according to claim 15, wherein the seal is pressurized.

17. A method according to claim 16, wherein the seal is gas pressurized.

18. A method according to claim 17, wherein the seal is pressurized by compressed air.

19. Apparatus for twisting a textile yarn material comprising a liquid jet device adapted to apply a rotational force to the textile material transversely to the axis of the material as the material travels along a predetermined path through the jet device, wherein the liquid jet device has a housing with a seal for preventing escape of liquid along the path.

20. Apparatus according to claim 19, comprising cooling apparatus.

21. Apparatus according to claim 19, wherein water is provided to cool the textile yarn material.

22. Apparatus according to claim 19, wherein the liquid jet device cools the textile yarn material.

23. Apparatus according to claim 14, wherein the liquid jet device is adapted to apply a force to the travelling material along the axis of the material.

24. Apparatus according to claim 23, wherein the liquid jet device applies at least one jet of liquid to the surface of the material transversely to the axis thereof.

25. Apparatus according to claim 24, the at least one jet of liquid is offset from the axis of the material.

26. Apparatus according to claim 24, wherein the at least one jet of liquid is directed to have velocity components both along and laterally of the material path through the jet device.

27. Apparatus according to claim 19, wherein the liquid jet device comprises a housing having an axial bore terminating in a material constricting outlet, the axis of the bore defining a material path therethrough, with at least one liquid flow channel aimed towards the outlet and offset from the axis.

28. Apparatus according to claim 19, wherein the liquid jet device comprises a water jet device.

* * * * *

UNITED STATES PATENT AND TRADEMARK OFFICE

CERTIFICATE OF CORRECTION

PATENT NO. : 6,701,704 B2
APPLICATION NO. : 10/041051
DATED : March 9, 2004
INVENTOR(S) : Peter William Foster et al.

It is certified that error appears in the above-identified patent and that said Letters Patent is hereby corrected as shown below:

Column 10, line 15, “43” should be -- 13 --

Column 12, line 54 (claim 1), “farce” should be -- force --

Column 14, line 19 (claim 25), after “24,” insert -- wherein --

Signed and Sealed this

Fifth Day of December, 2006

JON W. DUDAS
*Director of the United States Patent and Trademark Office*